United States Patent [19]

Cruchon et al.

[11] Patent Number: 4,578,657

[45] Date of Patent: Mar. 25, 1986

[54] FILTER OF THE TYPE CONSISTING OF A PRIMARY WAVEGUIDE HAVING LATERAL SECONDARY GUIDES

[75] Inventors: Jean-Claude Cruchon, Bouffemont; Jean-Denis Schubert, Verneuil sur Seine, both of France

[73] Assignee: Alcatel Thomson Faisceaux Hertziens, Levallois Perret, France

[21] Appl. No.: 739,588

[22] Filed: May 30, 1985

[30] Foreign Application Priority Data

May 30, 1984 [FR] France ..... 84 08496

[51] Int. Cl.[4] ..... H01P 1/212; H01P 1/22; H01P 1/162; H01P 5/02

[52] U.S. Cl. ..... 333/211; 333/34; 333/248; 333/251

[58] Field of Search ..... 333/202, 208–212, 333/33, 34, 81 B, 248, 251, 22 R, 22 F

[56] References Cited

U.S. PATENT DOCUMENTS

| | | | |
|---|---|---|---|
| 3,187,277 | 6/1965 | Wantuch | 333/248 X |
| 3,543,199 | 11/1970 | Quine et al. | 333/33 X |
| 3,593,220 | 7/1971 | Rooney | 333/211 |

*Primary Examiner*—Marvin L. Nussbaum

*Attorney, Agent, or Firm*—Sughrue, Mion, Zinn, Macpeak, and Seas

[57] ABSTRACT

Filter comprising a rectangular waveguide extended at both ends by rectangular guide-to-rectangular guide couplers and provided with lateral secondary guides. In order to enable the use of cylindrical secondary guides without introducing unwanted resonances, said couplers are given, at their ends, rectangular internal cross sections both the height and width whereof are smaller at the end coupled to the primary guide than at the end remote from the primary guide.

4 Claims, 3 Drawing Figures

FILTER OF THE TYPE CONSISTING OF A PRIMARY WAVEGUIDE HAVING LATERAL SECONDARY GUIDES

FIELD OF THE INVENTION

This invention relates to a filter comprising a primary waveguide, the two ends whereof are coupled to the two filter openings, and at least one lateral, secondary guide one of the ends whereof issues into a hole drilled in the wall of the primary guide and the other end whereof is generally terminated by an absorbing material.

BACKGROUND OF THE INVENTION

Such filters are known and are, for example, connected in the output switching circuits of power amplifiers operating on centimeter waves in order to reduce the rate of harmonic radiation in space.

The known filters consist of a rectangular primary waveguide the four sides or at least one of the two broad sides whereof are attached to lateral guides which are also rectangular but have a smaller cross section than the primary guide. The two openings of these filters are sometimes provided with a taper or a stepped impedance matching means; such impedance matching means, which forms a rectangular guide-to-rectangular guide coupler, is intended to boost the coupling of the lateral guides by reducing the distance between the two broad sides of the main guide, which is to say, by providing an internal cross section for the main guide the small sides whereof are smaller than those of the filter openings (inlets and outlets); the broad sides on the other hand are given the same dimensions as the broad sides of the outside rectangular guides to which the filter is coupled.

These prior art filters are costly due to the large number of lateral guides which must generally be associated with the primary guide. Moreover, they are very difficult to manufacture using electroerosion or electroforming techniques.

It is the object of this invention to obviate, or at least abate these disadvantages.

SUMMARY OF THE INVENTION

This object is attained, in particular, by using cylindrical secondary guides, said cylindrical guides being easier to make and easier to fit to the primary guide than are rectangular secondary guides. Significantly, although the substitution of cylindrical secondary guides for the rectangular secondary guides seems an obvious solution, it in fact raises problems which, it appears, had not been seriously analyzed and, above all, solved hereto. This explains why only rectangular-lateral-guide filters have been made so far. The description of the invention given hereinafter will point out the precautions which must be taken to ensure correct operation of filters with cylindrical secondary guides.

The invention provides a filter comprising a rectangular primary guide, n secondary guides—where n is a whole number at least equal to 1—coupled by one of their ends to the primary guide via holes or apertures through the wall of said primary guide, and two impedance matching means of the rectangular guide-to-rectangular guide coupling type, respectively coupled to the two ends of the primary guide, wherein said n secondary guides are cylindrical guides and the ends of said impedance transformers have rectangular internal cross sections the width and height whereof are both smaller on the primary guide coupling side than on the side opposite the primary guide.

The invention will be more readily understood and further features will become apparent from the following description, taken with reference to the accompanying drawings.

DESCRIPTION OF THE PREFERRED EMBODIMENT

Figure 1:
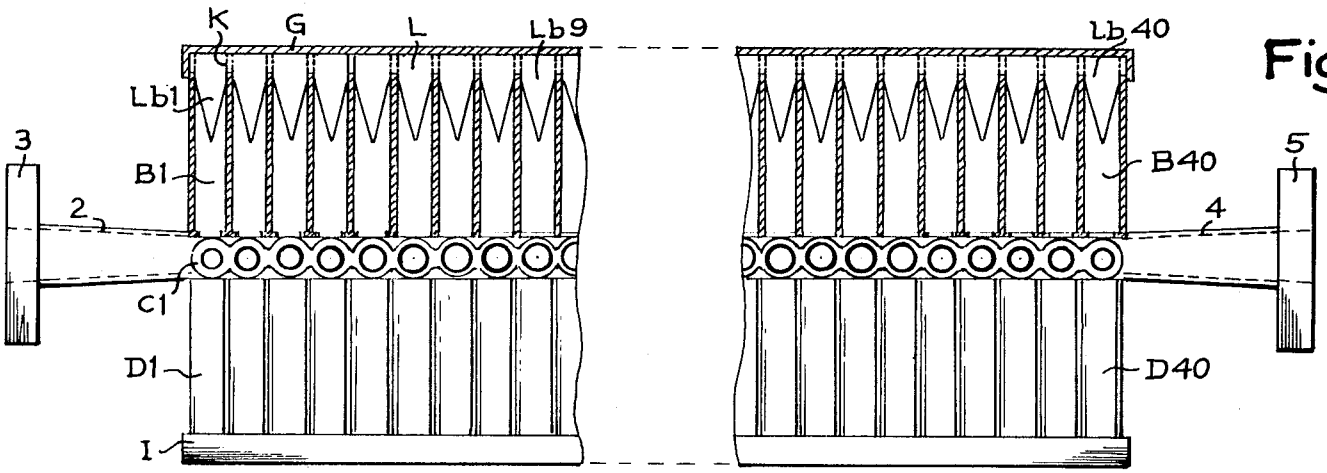
FIG. 1 is a schematic drawing of the filter according to the invention seen from the side.

FIG. 1 shows a partial side view of a filter according to the invention, with a part thereof shown broken away.

Figure 2:
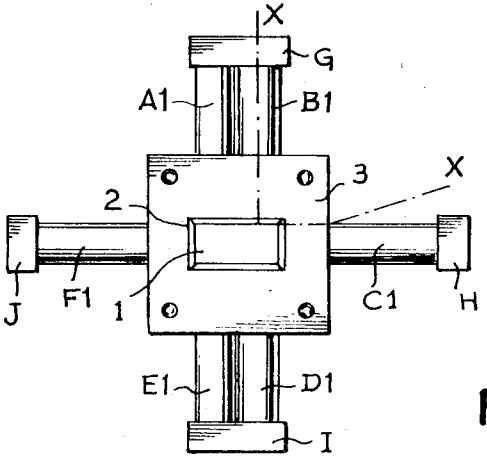
FIG. 2 is an end view of the filter of FIG. 1.

FIG. 2, which shows an end view of the same filter, includes an axial line, XX, locating the broken away section of FIG. 1; besides this breakaway, the transition from FIG. 2 to FIG. 1 involves removing part H of FIG. 2. As can be seen from the first two figures, the filter comprises the following parts:

- a mounting flange 3;
- an impedance matching coupler 2 which, together with the flange 3, is 30 mm long and which tapers from an internal cross section of 15.8×7.9 mm at the flange end to 14×7 mm at the other end;
- a rectangular primary guide 1, 270 mm-long, with an internal cross section of 14×7 mm; said primary guide is surrounded by forty lateral assemblies each comprising six cylindrical secondary guides, such as A1, B1, C1, D1, E1, F1, arranged in the same cross-sectional plane of primary guide 1;
- an impedance matcher 4, arranged symmetrically to impedance matcher 2 about a plane of symmetry formed by the plane, not shown, crossing through the center of guide 1;
- and a mounting flange 5, symmetrical to flange 3 with respect to the above-mentioned plane of symmetry.

It should be noted that in the embodiment described, the entire filter, and not just flanges 3 and 5 and impedance transformers 2 and 4, is symmetrical with respect to said plane of symmetry, thus making the filter fully reversible.

Each of the 40 previously-mentioned assemblies comprises:

- six cylindrical secondary guides such as A1 through F1, distributed along a same transverse plane of main guide 1, two of which, such as A1, B1 in FIG. 2, issue into one of the broad sides of said primary guide 1, two more of which, such as D1, E1, issue into the other broad side of guide 1, and the remaining two of which, such as C1, F1, issue respectively into the two small sides of guide 1, all of the secondary guides in said forty assemblies having an internal diameter of 5.38 mm and a length of 30 mm, said secondary guides forming, in the lengthwise direction of guide 1, six alignments of forty parallel and contiguous guides, such as B1–B40 and D1–D40 in FIG. 1;
- covers closing off the ends of said secondary guides opposite the primary guide, said end covers being associated to form four large covers G, H, I and J respectively covering all the secondary guides such as A1, B1, C1, D1, E1 and F1;

and terminations such as Lb1,Lb9, Lb40(FIG. 1) consisting a 2 mm-thick absorbing materials inserted into the ends of all of the secondary guides opposite the primary guide, the fillers of all forty secondary guides in a given row being connected together through slots such as K provided in the outside ends of the secondary guides in contiguous portions thereof, said terminations so forming six saw blades, such as L, the forty teeth whereof thus constitute forty secondary guide fillers.

The filter's secondary guides issue into guide 1 via circular apertures with a diameter of 5.38 mm, equal to the internal diameter of the guides, except for the first five and last five guides in each row, the coupling apertures whereto are given a smaller diameter to avoid capturing too large a fraction of the energy of primary guide 1. The diameters of the first four apertures from the ends of the rows are 4.16, 4.40, 4.67 and 4.95 mm, respectively. Thus, the secondary waveguide couplings increase gradually after the first from the filter openings—a feature which reduces the power applied to the first fillers and prevents their destruction by a high input power. Since this gradual augmentation of the secondary waveguide couplings occurs at both ends of the filter, both ends can serve as inlets, there being no reason to favor one end over the other for purposes of power dissipation in the first fillers. The thirty remaining secondary guides of each row all being identical and issuing by identical apertures into guide 1, the middle portion of the filter in FIG. 1 has been left out of the drawing to allow the parts shown to be drawn to a large enough scale to enable a clear rendering of their details.

Figure 3:
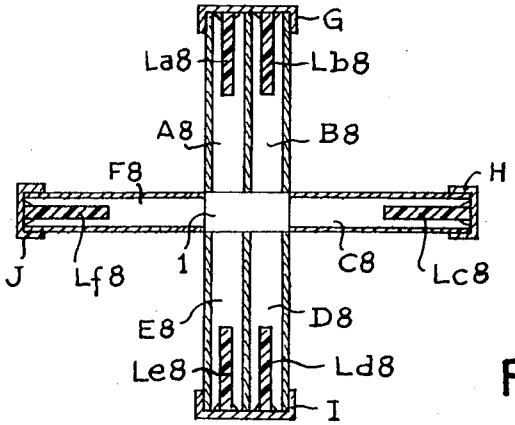
FIG. 3 is a cross section of the filter shown in FIGS. 1 and 2.

FIG. 3, the cross section of the same filter as in FIGS. 1 and 2, taken at the eighth lateral assembly counting from the left end of FIG. 1, shows the six secondary guides A8, B8, C8, D8, E8, F8 with their respective fillers La8, Lb8, Lc8, Ld8, Le8, Lf8 and covers G, H, I, J. The fillers are secured in the covers by glueing.

The filter just described is a 2nd harmonic filter designed to pass a fundamental frequency in the 17.3 to 18.1 GHz range. It performed as follows with a test input power of 1.3 kW: losses affecting the fundamental were 0.11 dB and the standing-wave ratio was 1.035; for a 2nd harmonic in the range 34.6–36.2 GHz, losses were above 50 dB and the standing-wave ratio was 1.23.

The manufacture of this filter raised a number of problems. In fact, it was attempted to start from a conventional filter with rectangular secondary guides and merely replace the latter by cylindrical guides. However, there appeared, in addition to the TE11 mode, unwanted modes TE10 and TE20 (TE01 and TE02 in the French language transcription). This occurrence can be explained by the fact that the rectangular secondary waveguides of the prior art were relatively "flat", making their internal cross section and consequently their coupling aperture small, this feature avoiding the creation of interferences in the primary guide. With cylindrical secondary guides on the other hand, the cross sections are large, since it is no longer possible to reduce width without reducing height, and large discontinuities (cutouts) are necessarily provided in the wall of the primary guide. Such discontinuities bring about an artificial widening of the primary guide and accordingly the cutoff frequency for the first two spurious modes TE10 and TE20 is lowered, causing unwanted resonances, particularly in the 17.3–18.1 GHz band.

It might have been possible to cut back the size of the coupling apertures to each of the secondary guides to avoid such interferences. However, again because of the large cross sections of the cylindrical guides, it would not have been possible to align enough such cylindrical secondary guides to receive the same amount of energy per unit length of filter and the resulting filters would have to be roughly twice the length of rectangular secondary guide filters for the same performance. Such bulkiness is unacceptable for most applications.

The solution for avoiding the stated disadvantages, as appears from the description made herein with reference to FIGS. 1 through 3, consists in reducing both the height and width of the primary guide, and, incidentally, gradually reducing the coupling of the secondary guides towards the filter openings.

It will be understood that the present invention is not limited to the embodiment described and that certain changes might occur to those skilled in the art without departing from the scope and spirit of the invention. For example, the primary guide could be provided with lateral secondary guides only on its two broad sides or on one side alone. Also, the number of secondary guides, although it must be at least equal to 1, is limited only by the space available for the filter. The secondary guides could also be filled with a dielectric to reduce their cross section without raising their cutoff frequency, or they could be differently distributed along the primary guide, notably in an irregular pattern. As for the impedance matchers in the filter openings, such as 2 and 4, these could be either taper types or stepped types.

What is claimed is:

1. A filter comprising a rectangular primary waveguide, n secondary guides, n being a whole number at least equal to 1, said n secondary guides being coupled by one of their ends to the primary guide via apertures through the wall of said primary guide, and two impedance matchers of the rectangular-guide-to-rectangular-guide coupling type, respectively coupled to the two ends of the primary guides, wherein said n secondary guides are cylindrical guides and the impedance transformers are provided with rectangular internal cross sections at their extremities having both the height and width whereof smaller on the side coupled to said primary guide than on the side opposite the primary guide.

2. Filter according to claim 1, wherein a number m of the n secondary waveguides, m and n being at least equal to 3 and m being at most equal to n, are arranged in a row along said primary guide and issue into the primary guide respectively via m apertures in a same side of the primary guide, and wherein k and p apertures (k and p being whole numbers never greater than (m/2) among the m which are respectively the closest to the ends of the primary guide, have cross sections which are all the smaller for the aperture's closeness to the nearest end of the primary guide.

3. Filter according to claim 1, comprising n terminations of an absorbing material, disposed in the secondary guides, in their ends furthest from the primary guide and wherein j of the n secondary guides (j and n at least equal to 2 and j at most equal to n) form a row of juxtaposed guides, j of said n terminations being juxtaposed to form a saw-toothed means whose j teeth respectively fit into said j secondary guides.

4. Filter according to claim 3, wherein a cover is attached to the j juxtaposed terminations and covers the ends of the j secondary guides opposite the primary guide.

* * * * *